US005958492A

United States Patent [19]

Jens et al.

[11] Patent Number: 5,958,492

[45] **Date of Patent: *Sep. 28, 1999**

[54] FIGURE CUTTER FOR FOOD SLICES

[75] Inventors: Stephen Chris Jens, Belmont, Mass.; Leon Alberto Espinel, Chicago, Ill.; Gilbert George Fryklund, Winchester, Mass.

[73] Assignee: Kraft Foods, Inc., Northfield, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/542,602

[22] Filed: Oct. 13, 1995

[51] Int. Cl.[6] ..... A22C 17/10; A23P 1/00; A23P 1/10

[52] U.S. Cl. ..... 426/383

[58] Field of Search ..... 426/87, 104, 129, 426/130, 264, 383, 414, 425, 518, 108; 425/237, 235; 94/276, 277

[56] References Cited

U.S. PATENT DOCUMENTS

| | | | |
|---|---|---|---|
| 1,784,906 | 12/1930 | Oxhandler . | |
| 2,714,861 | 8/1955 | Castronuovo | 99/450.4 |
| 2,763,049 | 9/1956 | Peebles . | |
| 3,302,592 | 2/1967 | Werner . | |
| 3,303,796 | 2/1967 | Novissimo . | |
| 3,410,699 | 11/1968 | Peters | 426/104 |
| 3,809,774 | 5/1974 | Raitt . | |
| 3,863,020 | 1/1975 | Robinson . | |
| 3,887,719 | 6/1975 | Miller . | |
| 4,027,457 | 6/1977 | Johnson et al. . | |
| 4,238,178 | 12/1980 | Bailey . | |
| 4,352,831 | 10/1982 | Cavanagh et al. . | |
| 4,397,871 | 8/1983 | Meyer et al. | 426/605 |
| 4,560,562 | 12/1985 | Schroeder | 426/87 |
| 4,630,426 | 12/1986 | Gentry | 53/428 |
| 4,665,811 | 5/1987 | Meyer . | |
| 4,946,640 | 8/1990 | Nathoo . | |
| 5,205,106 | 4/1993 | Zimmermann et al. . | |
| 5,388,489 | 2/1995 | Dayley | 83/117 |
| 5,885,642 | 3/1999 | Hederer et al. | 426/582 |

FOREIGN PATENT DOCUMENTS

| | | |
|---|---|---|
| 553322 | 2/1958 | Canada . |
| 1101438 | 6/1955 | France . |
| 3146754 | 6/1988 | Japan . |
| 795083 | 5/1958 | United Kingdom . |

*Primary Examiner*—Curtis E. Sherrer
*Attorney, Agent, or Firm*—Fitch, Even, Tabin & Flannery

[57] ABSTRACT

A sliced food product such as a cheese product or meat product having a design or figure cut or otherwise formed therein. In accordance with a preferred embodiment, the design or figure is cut entirely or substantially through the slice so that the design or figure may be removed from a surrounding peripheral portion of the slice. A method and apparatus for forming the figure or design are also disclosed. The preferred method and apparatus employ a rotary figure cutter which cuts entirely through the slice to outline a pattern or figure, and which cuts or penetrates partially through the slice to form details of the figure by embossing or indenting design components on the slice. The slice is preferably wrapped in film prior to the figure cutting operation, and the figure cutter performs its function without cutting or tearing the film wrap. The rotary figure cutter preferably comprises a pair of rotary dies between which each slice passes as the design is formed thereon.

8 Claims, 3 Drawing Sheets

FIGURE CUTTER FOR FOOD SLICES

BACKGROUND OF THE INVENTION

The invention relates generally to food products sold in slice form, and more particularly to a sliced food product having a design formed therein, and a method and apparatus for forming the design in the food slice.

In the past, sliced cheese products such as natural cheese, process cheese, process cheese food, and process cheese spread, as well as sliced meat products such as ham, bologna, salami, and other cold cuts, have typically been packaged and sold in unadorned, simple rectangular or circular shapes.

One of the problems in attempting to provide designs or patterns on slices of food products such as those referred to above is that these products generally have a relatively low tensile strength and therefore are generally susceptible to separating, tearing, and/or breaking during handling. As mentioned in U.S. Pat. No. 3,887,719, this problem is particularly notable in process cheese spread, due to its high moisture content. Slices of these cheese products are often individually wrapped for consumer sale, and packaged in stacks with a plastic film overwrap.

In any operation involving formation of designs on a slice of one of the above-mentioned products, care must be taken to avoid unduly high stresses and strains which would result in loss of slice integrity, and to avoid creation of tears, cracks, or other discontinuities which could propagate under the stresses associated with later handling and packaging. It is desirable that the slices be capable of withstanding packaging operations which may entail individual wrapping of slices as well as separating, stacking and overwrapping, and that the slices also be capable of withstanding handling by the consumer, i.e., removal of overwrap and individual wrap, without loss of integrity.

SUMMARY OF THE INVENTION

In accordance with the invention, there is provided a sliced food product such as a cheese product or meat product having a design cut or otherwise formed therein. In accordance with a preferred embodiment, the design is cut entirely or substantially through the slice so that the design or figure may be removed from a surrounding peripheral portion of the slice.

The invention also comprises a method and apparatus for forming the design. The preferred method and apparatus employ a rotary figure cutter which cuts entirely through the slice to outline the design, and which cuts or penetrates partially through the slice to form details of the figure by embossing or indenting interior design components on the slice. The rotary figure cutter may comprise a pair of rotary dies between which the slice passes. In the preferred method, the slice is wrapped in film prior to the figure cutting operation, and the figure cutter performs its function without cutting or tearing the film wrap.

DETAILED DESCRIPTION OF PREFERRED EMBODIMENT

Figure 1:
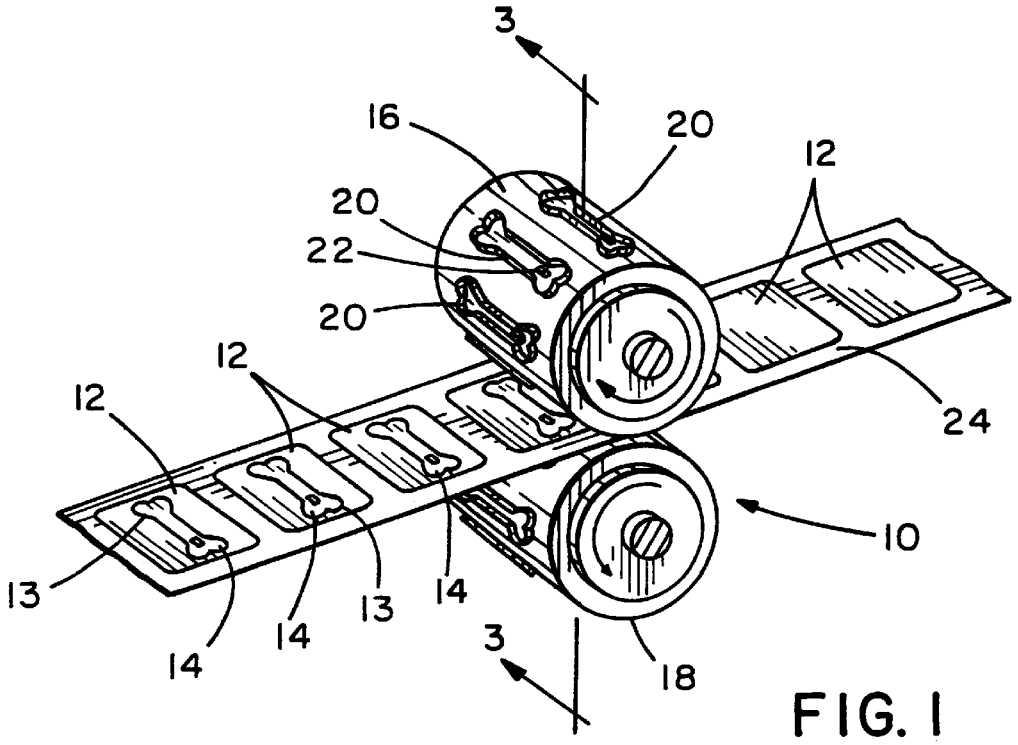
FIG. 1 is a diagrammatic perspective view illustrating a method and apparatus in accordance with an embodiment of the invention.

The invention is generally embodied in a sliced food product having a design cut, embossed, or otherwise formed thereon, and in a method and apparatus for forming the design. The sliced food product may comprise cheese slices, or other sliced food products such as ham, salami, bologna, or other cold cuts. The term "cheese" is used herein to refer generally to cheese products such as natural cheese, process cheese, process cheese food, and cheese spread. For purposes of example, it may be noted that a typical cheese slice may have a thickness of about 0.1 in.

FIGS. 1 through 4 illustrate apparatus 10 for cutting and embossing slices 12 to form a figure in a series of slices which are at least partially covered by a film wrap 11 in accordance with a preferred embodiment of the invention. The term "embossing" is used generally herein to denote an operation which forms a design on the slice without cutting through its entire thickness. Examples of "embossing" as that term is used herein might include forming indentations, grooves, dimples, or recesses in a surface of the slice, or forming raised ridges or other raised regions on a surface of the slice.

In the illustrated embodiment, a design 13 is cut into the slice to form a "pop out" figure 14 in the slice which may easily be separated from the surrounding peripheral portion of the slice. The outline of the figure is cut entirely through the slice in the preferred embodiment. Additional components of the design may be simply embossed on the cheese slice, rather than being cut entirely therethrough. This technique enables relatively detailed designs to be formed without unduly compromising the structural integrity of the slice. The outline of the figure preferably takes the form of a continuous closed curve, but may alternatively comprise a perforated line or curve, or a series of line segments or unconnected curves, or may take other forms. The illustrated design, shown for purposes of example only, depicts a bone. It is contemplated that other designs may depict other items or characters such as dinosaurs, cartoon characters, etc., or may take other forms. In each case, the design preferably comprises a closed curve which has relatively large radii of curvature over most of its length.

In the illustrated embodiment, the apparatus generally comprises upper and lower rotary dies 16, 18 which cooperate to cut and emboss the design 13 on a series of slices 12 passing therebetween. Each of the rotary dies has a series of raised cutting die members 20, 22 thereon. Each cutting die member defines a cutting pattern. Each cutting pattern 20 on the upper die 16 has a corresponding mirror image pattern 22 on the lower die 18. The respective cutting patterns 20, 22 match or register with one another along their entire lengths.

The slices are preferably supported on a continuous ribbon or web of film 24 as they are transported between the upper and lower rotary dies 16 and 18. The slices may be disposed between two separate ribbons or webs, one above and one below, or may alternatively be supported by a single web which has been wrapped around the slices to cover both the top and bottom surfaces thereof. In either case, the film wrap comprises an upper component 26 and a lower component 28 disposed respectively above and below the slice.

The preferred rotary dies provide an advantage relative to the use of flat or planar dies which might be reciprocated in rectilinear motion to effect cutting of the designs in the cheese slices, in that the rotary dies 16, 18 engage the slices 12 in line contact, so that the stress and strain on the slice and the film wrap 11 at any particular point in time is localized, and of relatively low magnitude. Thus, while it may be possible, in some embodiments of the invention, to form similar designs in a stamping operation, the rotary dies are believed to be superior in the context of forming designs on individually-wrapped cheese slices in a commercial cheese plant, operating at production speeds. The illustrated embodiment is believed to be feasible for in-line formation of designs on cheese slices, i.e., formation of designs on slices in line with apparatus for commercial production and packaging of the slices.

Figure 4:
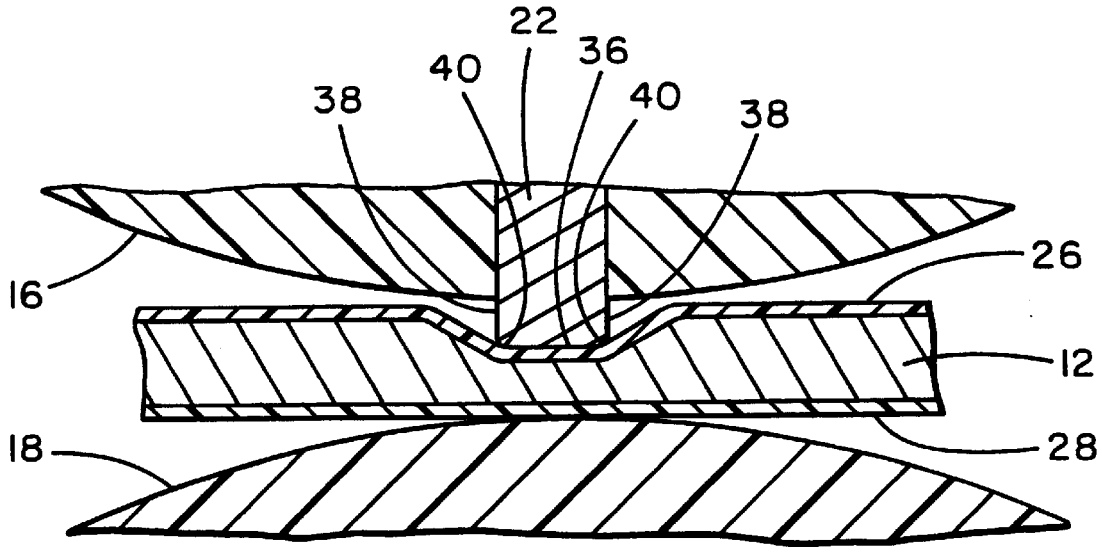
FIG. 4 is a sectional view illustrating an embossing die member embossing a design on a slice of food product in accordance with an embodiment of the invention.
Figure 5:
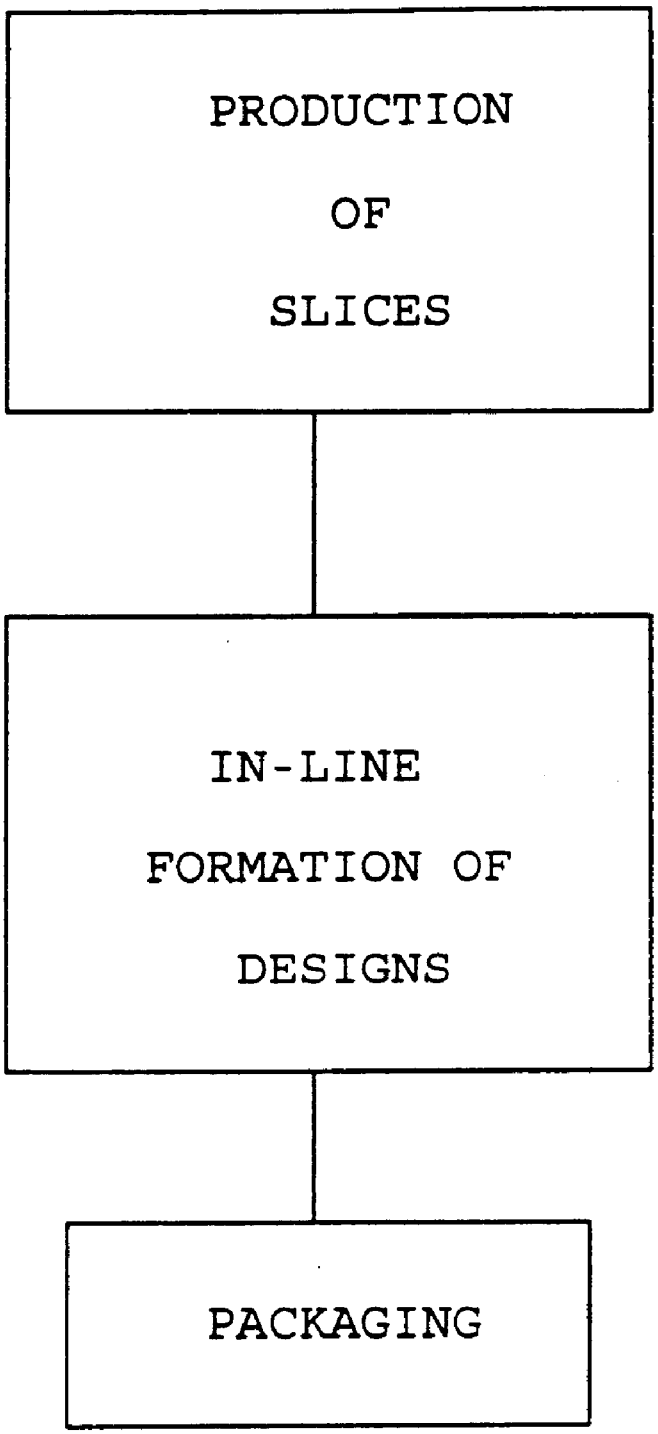
FIG. 5 is a flow diagram illustrating a commercial process for producing food slices utilizing a method for forming a design on the slices in accordance with an embodiment of the invention.

In some embodiments of the invention, the design may consist entirely of a single closed curve defining an outline of a figure. In the illustrated embodiment, the design comprises a closed curve plus an additional component disposed within the closed curve. To emboss the additional component on the slice, a separate embossing die member is provided on one, but not both, of the rotary dies in the preferred embodiment. As shown in FIG. 4, the embossing die member 22 in the illustrated embodiment penetrates only partly into the thickness of the slice, rather than penetrating entirely therethrough. The embossing die member preferably has a radial dimension of at least about half of the thickness of the slice, so as to effect parting of the slice material at least halfway through its thickness. The illustrated embossing die member 22 takes the form of a short line segment. In other embodiments, the embossing die member may take the form of a closed curve, a large solid pattern, a plurality of line segments, or other shapes and combinations thereof.

Opposite the embossing member 22 is a hard rubber or other appropriate cylindrical support surface on the lower rotary die 18 which supports the slice in reaction to the embossing forces so that an indentation, or other embossed pattern grooves may be formed in the upper surface of the slice by the embossing die member without a corresponding deformation of the opposite, lower surface.

To aid in avoidance of cutting, tearing, or unduly straining the film wrap, each cutting die member 20 preferably has a substantially flat end surface 30 and substantially flat side surfaces 32 perpendicular thereto, which adjoin one another at edges or corners 34 having a cross-sectional radius of curvature of about 0.01 in. The embossing pattern or embossing die member is similarly configured, comprising a substantially planar end surface 36 intersecting substantially at edges 40. Each of the cutting die members and embossing die members preferably has a width of about 0.075 in.

Figure 3:
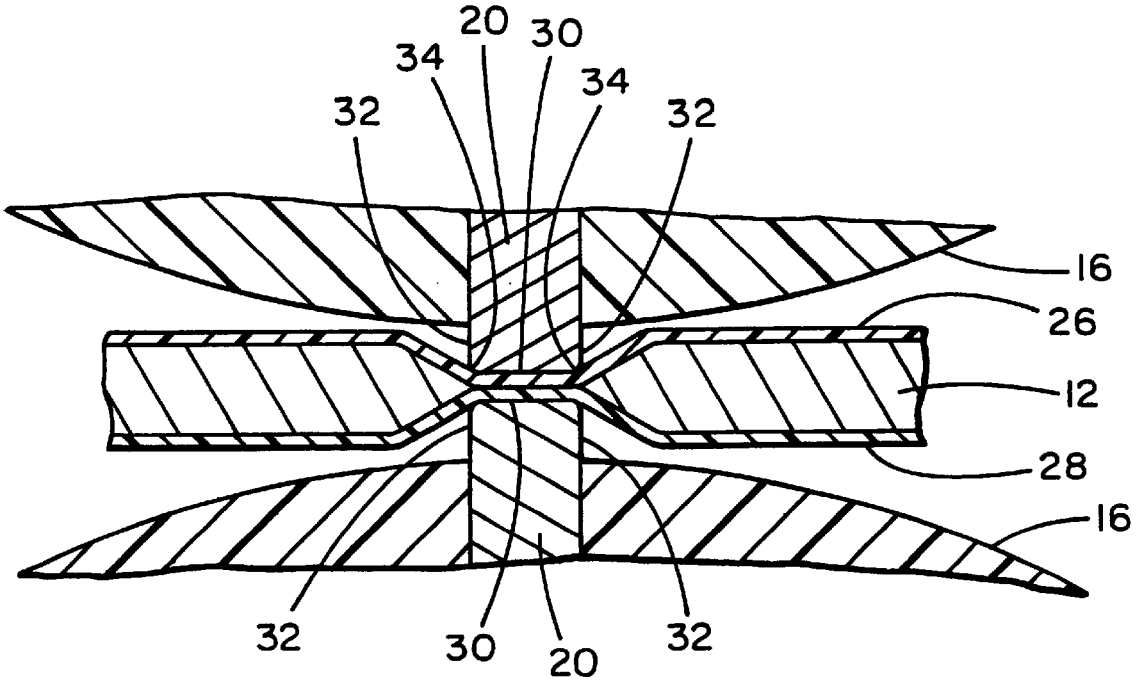
FIG. 3 is a transverse sectional view illustrating a cutting die member cutting a design in a food product slice in accordance with an embodiment of the invention.

As illustrated in FIG. 3, during the cutting operation, the top and bottom components of the film wrap are pressed together locally into contact with each other, effecting localized separation of the food product, forcing the food product to be displaced to either side of the cutting die member 20. The cutting die members are preferably positioned so as to be spaced from one another by a distance approximately equal to the combined thickness of the upper and lower film wrap components, which will generally be less than 0.01 in. and may be about 0.002–0.003 in. After the cutting die members separate, the film wrap components may recover from the displacement by the cutting die members to rebound somewhat toward their initial positions, and the food product may also rebound somewhat.

Figure 2:
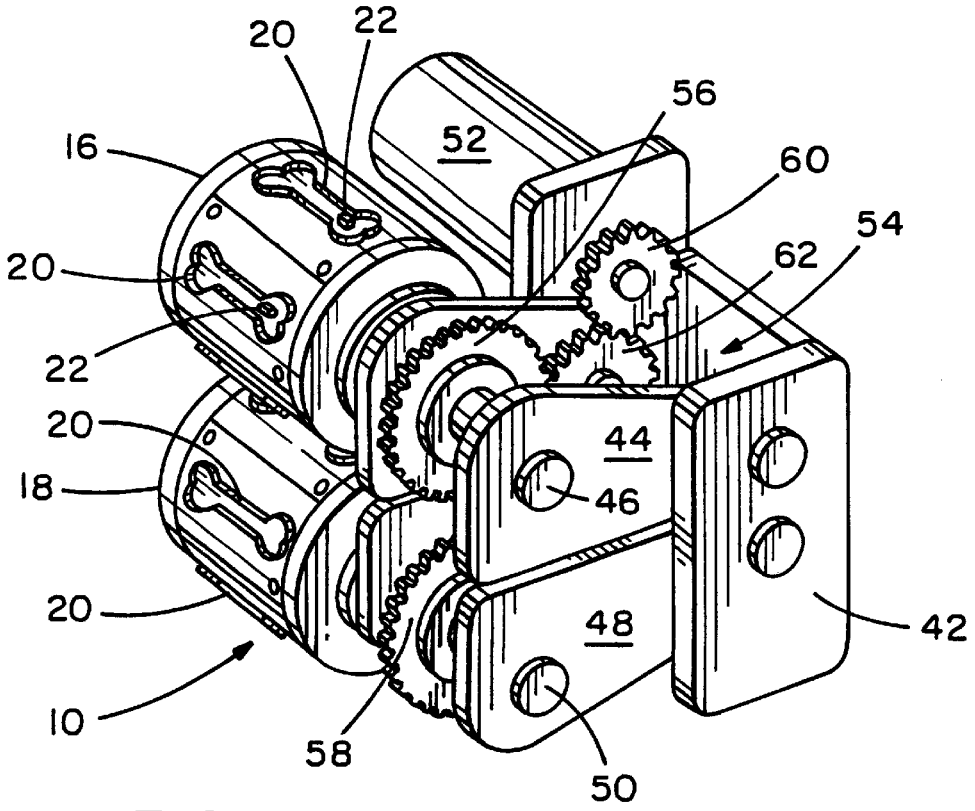
FIG. 2 is a more detailed perspective view of apparatus in accordance with an embodiment of the invention.

FIG. 2 shows the apparatus 10 in more detail. The rotary dies 16 and 18 are preferably connected to one another by suitable timing means to ensure that their respective rotations will be synchronized with each other, and with the travel of the slices. This enables the figure 14 to be reliably placed at a uniform location on each slice. In the illustrated embodiment, the figure is intended to be centered on each slice.

The apparatus 10 as illustrated in FIG. 2 generally comprises a frame 42 having upper support members 44 for rotatably supporting the shaft 46 of the upper rotary die 16; lower support members 48 for supporting the shaft 50 of the lower rotary die 18; and a motor 52 or other means for driving the rotary dies through transmission 54 comprising spur gears 56, 58, and 60 on the respective shafts of the rotary dies and of the motor, and one or more intermediate gears 62.

After the cutting/embossing operation, the slices may proceed to a cutter/sealer which separates the wrapped slices into individual units, and effects sealing, if desired, of each slice individually and separately. The sealing may take place before or after the separating of the slices from one another.

From the foregoing it should be appreciated that the invention provides a novel method and apparatus for cutting and embossing figures or designs in a soft food product such as a cheese product or a meat product having a relatively low tensile strength. As noted above, the use of rotary dies in the preferred embodiment, as opposed to, e.g., a flat stamping operation, enables the operation to be carried out with line contact which generally involves lower pressures and less collateral damage to the slices than would other operations. The use of embossing techniques to form details of the design in the preferred embodiment avoids unnecessary weakening of the slices.

As an alternative to the transmission described above in connection with the preferred embodiment, the transmission might comprise belt drives, chain drives, or other mechanical linkages. The transmission may link the motor mechanically to means for driving the web, or the apparatus may employ an electronic controller to drive the motor 52 to maintain a timed relationship between slice travel and die rotation. Alternatively, rather than having a motor or other drive means dedicated to driving the rotary dies, the rotary dies could be driven directly by linear travel of the web.

The invention is not limited to the particular embodiments described above, or to any particular embodiments, but rather is defined by the claims which follow.

What is claimed is:

1. A method of providing a design on a series of slices of a low tensile strength food product which are at least partially wrapped, with first and second film wrap components covering opposite sides of each slice, said method comprising:

providing a series of defined slices, each having a predetermined shape;

feeding said defined slices serially between a pair of rotary dies;

providing a cutting member on each of said rotary dies;

cutting the design into each said defined slice while it is continuously advancing by bringing said cutting members into close proximity with one another as said dies rotate so that said cutting members are separated from one another by a distance substantially equal to the combined thickness of the first and second film wrap components as they are cutting the design into said slice, thereby displacing food product from between the cutting dies without damaging the film wrap components while maintaining integrity of the slices of said low tensile strength food product, said design comprising a closed curve defining an outline of a figure to form an interior portion having the shape of the figure and a peripheral portion surrounding the interior portion, the interior portion being removable from the peripheral portion;

embossing an additional design component on said slice by impressing said additional design component into said slice to a depth less than the thickness of the slice, without cutting through the slice.

2. A method in accordance with claim 1 wherein said food product comprises a cheese product.

3. A method in accordance with claim 1 wherein said cutting member further comprises a substantially flat end surface.

4. A method in accordance with claim 3 wherein the end surface of said cutting member has a width of about 0.075 inch.

5. A method in accordance with claim 1 further comprising feeding a plurality of said slices to said rotary dies sequentially as a chain of preformed slices positioned adjacent one another on said film wrap.

6. A method in accordance with claim 1 wherein said additional design component is embossed by a second cutting member which comprises an end surface having a width of about 0.075 inch.

7. A method in accordance with claim 6 further comprising providing a support surface opposite said second cutting member to support said slice and limit unintended deformation of said slice when said additional design component is pressed into said slice.

8. A method of providing a design on a plurality of slices of a food product in a commercial plant at production speeds, in line with apparatus for commercial production and packaging of the slices, said method comprising:

providing a series of preformed slices of a low tensile strength food product which are at least partially wrapped, with first and second film wrap components covering opposite sides of each slice;

feeding said slices in line between a pair of rotary dies;

providing a cutting member on each of said rotary dies;

cutting the design into each said slice by bringing said cutting members into close proximity with one another as said dies rotate so that said cutting members are separated from one another by a distance substantially equal to the combined thickness of the first and second film wrap components as they are cutting the design into said slice, thereby displacing food product from between the cutting members without damaging the film wrap components while maintaining integrity of the slices of said low-tensile strength food product, said design comprising a closed curve defining an outline of a figure to form an interior portion having the shape of the figure and a peripheral portion surrounding the interior portion, the interior portion being removable from the peripheral portion; and embossing an additional design component on each said slice by impressing said additional design component into said slice to a depth less than the thickness of said slice, without cutting through the slice.

* * * * *